US007806812B2

(12) United States Patent
Humble et al.

(10) Patent No.: US 7,806,812 B2
(45) Date of Patent: Oct. 5, 2010

(54) FOLDABLE EXERCISE DEVICE

(75) Inventors: David R. Humble, Fort Lauderdale, FL (US); Hans A. Barth, Fort Lauderdale, FL (US)

(73) Assignee: Product Labs, Inc., Deerfield Beach, FL (US)

( * ) Notice: Subject to any disclaimer, the term of this patent is extended or adjusted under 35 U.S.C. 154(b) by 377 days.

(21) Appl. No.: 11/750,093

(22) Filed: May 17, 2007

(65) Prior Publication Data

US 2008/0287269 A1 Nov. 20, 2008

(51) Int. Cl.
*A63B 21/04* (2006.01)
*A63B 21/00* (2006.01)

(52) U.S. Cl. ..... 482/130; 482/133; 482/910

(58) Field of Classification Search ..... 482/92, 482/122, 123, 126, 129, 130, 133, 140, 142, 482/910; 297/53, 54

See application file for complete search history.

(56) References Cited

U.S. PATENT DOCUMENTS

| | | | | | |
|---|---|---|---|---|---|
| 4,805,901 | A * | 2/1989 | Kulick | 482/63 |
| 4,838,547 | A * | 6/1989 | Sterling | 482/128 |
| 5,176,601 | A * | 1/1993 | Reynolds | 482/130 |
| 5,669,865 | A * | 9/1997 | Gordon | 482/142 |
| 5,674,167 | A * | 10/1997 | Piaget et al. | 482/130 |
| 5,718,659 | A * | 2/1998 | Van Straaten | 482/130 |
| 5,899,836 | A * | 5/1999 | Chen | 482/92 |
| 5,906,566 | A * | 5/1999 | Whitcomb | 482/130 |
| 5,944,641 | A | 8/1999 | Habing | |
| 5,997,442 | A * | 12/1999 | Cordes | 482/52 |
| 6,152,866 | A * | 11/2000 | Kuo | 482/142 |
| 6,264,586 | B1 | 7/2001 | Webber | |
| 7,128,700 | B2 | 10/2006 | Wallach | |
| 7,226,401 | B2 * | 6/2007 | Van Stratten et al. | 482/112 |
| 7,294,096 | B1 * | 11/2007 | Stearns | 482/140 |
| 2008/0280734 | A1 * | 11/2008 | Dickie et al. | 482/54 |

FOREIGN PATENT DOCUMENTS

KR 10-2007-0045511 5/2007

OTHER PUBLICATIONS

Domyos: Fitness Cube, http://fitnesscube.domyos.com/EN/, Nov. 2006.

International Search Report dated Jul. 28, 2008 for PCT/US2008/063873.

* cited by examiner

*Primary Examiner*—Loan Thanh
*Assistant Examiner*—Allana Lewin
(74) *Attorney, Agent, or Firm*—Jon A. Gibbons; Fleit Gibbons Gutman Bongini & Bianco P.L.

(57) ABSTRACT

Disclosed is a foldable exercise device comprising a seat with a front and rear portion. The front portion is pivotably attached to at least one support member. The rear portion includes an intermediate pivotably lateral support member attached between first and second vertical support members. Each of the first and second vertical support members includes top and bottom ends. The seat is configured to pivot to at least two positions including an open position and a folded position. A back support is pivotably secured to the intermediate pivotable lateral support member. The back support is configured to pivot to at least two positions including an open position and a folded position. A resistance apparatus is secured between the first and second vertical support members. The resistance apparatus is configured to supply a variable resistive force when at least one connector coupled to the resistance apparatus is pulled by a user.

14 Claims, 8 Drawing Sheets

FOLDABLE EXERCISE DEVICE

FIELD OF THE INVENTION

The present invention generally relates to the field of exercise equipment, and more particularly relates to a space saving collapsible multi-purpose exercise device.

BACKGROUND OF THE INVENTION

Personal health and fitness has become increasingly popular over the recent years. As a result, health club memberships and personal fitness equipment sales have increased. Personal fitness equipment is especially popular because it allows individuals to exercise on their own time while in the convenience and privacy of their own homes. One type of personal fitness equipment is a multi-purpose exercise device that allows a user to perform various exercises. For example, a multi-purpose exercise device allows a user to perform exercises such as lateral pull-downs, butterfly presses, chest presses, isolated lateral rows, leg extensions, leg curls, abdominal crunches, and the like.

One problem with current multi-purpose exercise devices is the amount of installation space required. Many multi-purpose exercise devices occupy large amounts of space making them almost impractical for smaller homes or apartments. A user may be forced to purchase a smaller exercise device that offers fewer options in order to save space. Various multi-purpose exercise devices are currently available that try to overcome the large space requirements of most multi-purpose exercise devices.

However, these "space-saving" exercise devices also have problems and disadvantages. Exercise devices are that are designed to disassemble (completely or partially) require a user to manually do so. This can be very time consuming and tedious. Foldable exercise devices, in many instances, still require a user to disassemble at least part of the device. Therefore, these devices cannot be folded and stored as a single unit. Also, many of these exercise devices, when folded, still occupy a large ground area or vertical area and can become unsightly.

Therefore a need exists to overcome the problems with the prior art as discussed above.

SUMMARY OF THE INVENTION

Briefly, in accordance with the present invention, disclosed is a foldable exercise device comprising a seat with a front portion and a rear portion. The front portion is pivotably attached to at least one support member. The rear portion includes an intermediate pivotably lateral support member attached between a first vertical support member and a second vertical support member. Each of the first vertical support member and the second vertical support member include a top end and a bottom end. The seat is configured to pivot to at least two positions including an open position which is substantially horizontal and a folded position which is in a downward direction toward the bottom end of the first vertical support member and the second vertical support member. The back support is configured to pivot to at least two positions including an open position which is substantially vertically and a folded position which is substantially parallel to the seat. A resistance apparatus is secured between the first vertical support member and the second vertical support member. The resistance apparatus is configured to supply a variable resistive force when at least one connector coupled to the resistance apparatus is pulled by a user.

In another embodiment a foldable exercise device comprising a seat with a front portion and a rear portion is disclosed. The front portion is pivotably attached to at least one support member. The rear portion includes an intermediate pivotably lateral support member attached between a first vertical support member and a second vertical support member. Each of the first vertical support member and the second vertical support member include a top end and a bottom end. The seat is configured to pivot to at least two positions including an open position which is substantially horizontal and a folded position which is in a downward direction toward the bottom end of the first vertical support member and the second vertical support member. The foldable exercise device also comprises a base with front portion and a rear portion. The rear portion is attached to the bottom end of the first vertical support member and the bottom end of second vertical support member. A back support is pivotably secured to the intermediate pivotable lateral support member. A back support is pivotably secured to the intermediate pivotable lateral support member. The back support is configured to pivot to at least two positions including an open position which is substantially vertically and a folded position which is substantially parallel to the seat. A resistance apparatus is secured between the first vertical support member and the second vertical support member. The resistance apparatus is configured to supply a variable resistive force when at least one connector coupled to the resistance apparatus is pulled by a user.

In yet another embodiment a foldable exercise device comprising a seat with a front portion and a rear portion is disclosed. The front portion is pivotably attached to at least one support member. The rear portion includes an intermediate pivotably lateral support member attached between a first vertical support member and a second vertical support member. Each of the first vertical support member and the second vertical support member include a top end and a bottom end. The seat is configured to pivot to at least two positions including an open position which is substantially horizontal and a folded position which is in a downward direction toward the bottom end of the first vertical support member and the second vertical support member. The foldable exercise device also comprises an upper exercise member comprising a center support member, a right pivotable member, and a left pivotable member. The right pivotable member and the left pivotable member are pivotably secured to the center support member. The center support member is secured to the back support. A back support is pivotably secured to the intermediate pivotable lateral support member. A back support is pivotably secured to the intermediate pivotable lateral support member. The back support is configured to pivot to at least two positions including an open position which is substantially vertically and a folded position which is substantially parallel to the seat. A resistance apparatus is secured between the first vertical support member and the second vertical support member. The resistance apparatus is configured to supply a variable resistive force when at least one connector coupled to the resistance apparatus is pulled by a user.

BRIEF DESCRIPTION OF THE DRAWINGS

The accompanying figures where like reference numerals refer to identical or functionally similar elements throughout the separate views, and which together with the detailed description below are incorporated in and form part of the specification, serve to further illustrate various embodiments and to explain various principles and advantages all in accordance with the present invention.

DETAILED DESCRIPTION

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting; but rather, to provide an understandable description of the invention.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly, and not necessarily mechanically.

Although the invention is described in terms of a preferred specific embodiment, it will be readily apparent to those skilled in this art that various modifications, rearrangements, and substitutions can be made without departing from the spirit of the invention. The scope of the invention is defined by the claims appended hereto.

An advantage of the foregoing embodiments of the present invention is that a collapsible multi-purpose exercise device is provided. A user is able to perform multiple exercises on the present invention and configure the exercise device so suit personal exercise preferences. Another advantage of the preset invention is that it can be configured in such a manner that minimal storage space is required. For example, the present invention is configured so that various parts of the exercise device are collapsible and/or foldable thereby giving the present invention a small footprint when collapsed in a storage configuration.

Collapsible Multi-Purpose Exercise Device

Figure 1:
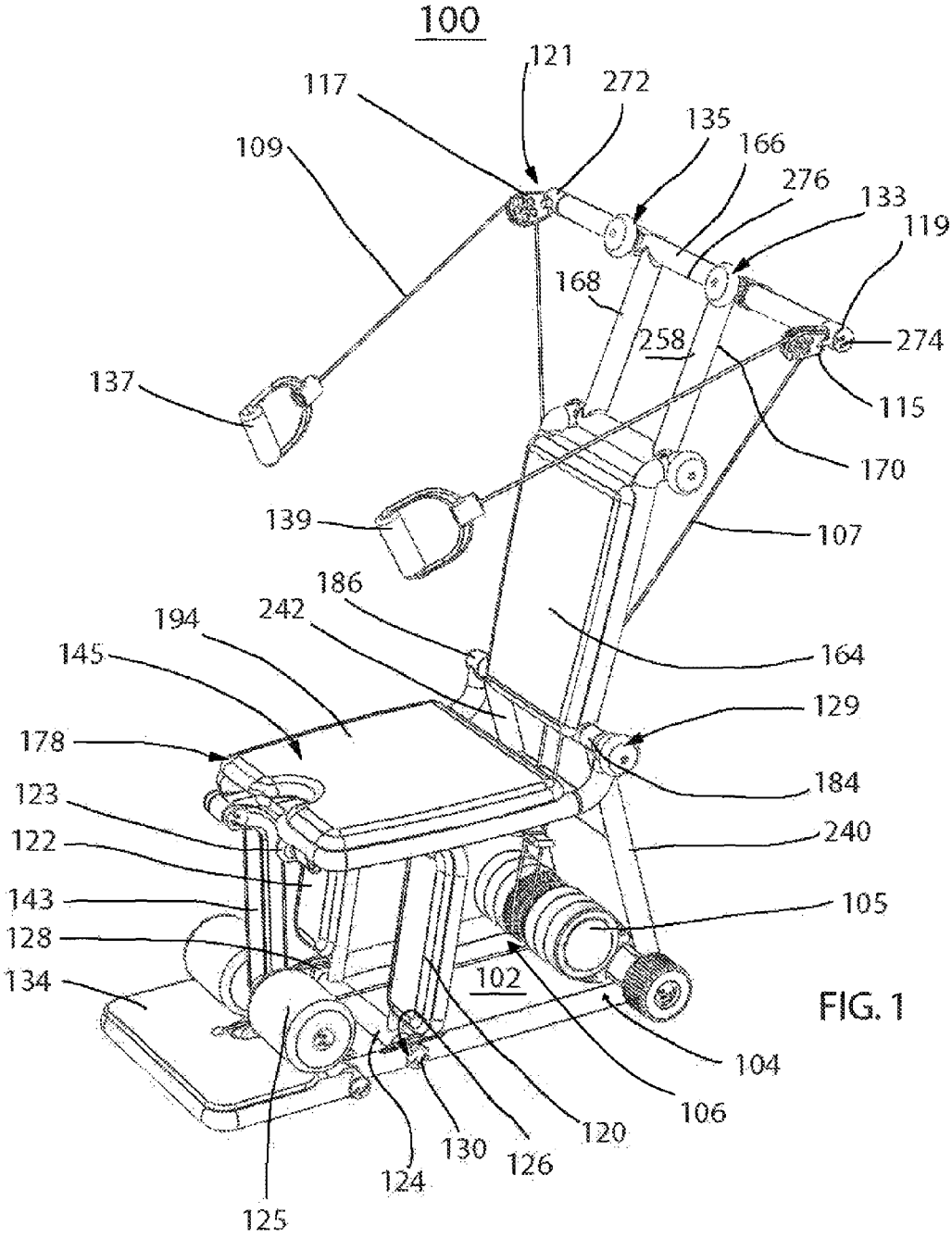
FIG. 1 is a front angled view of a multi-purpose exercise device, according to an embodiment of the present invention.
Figure 2:
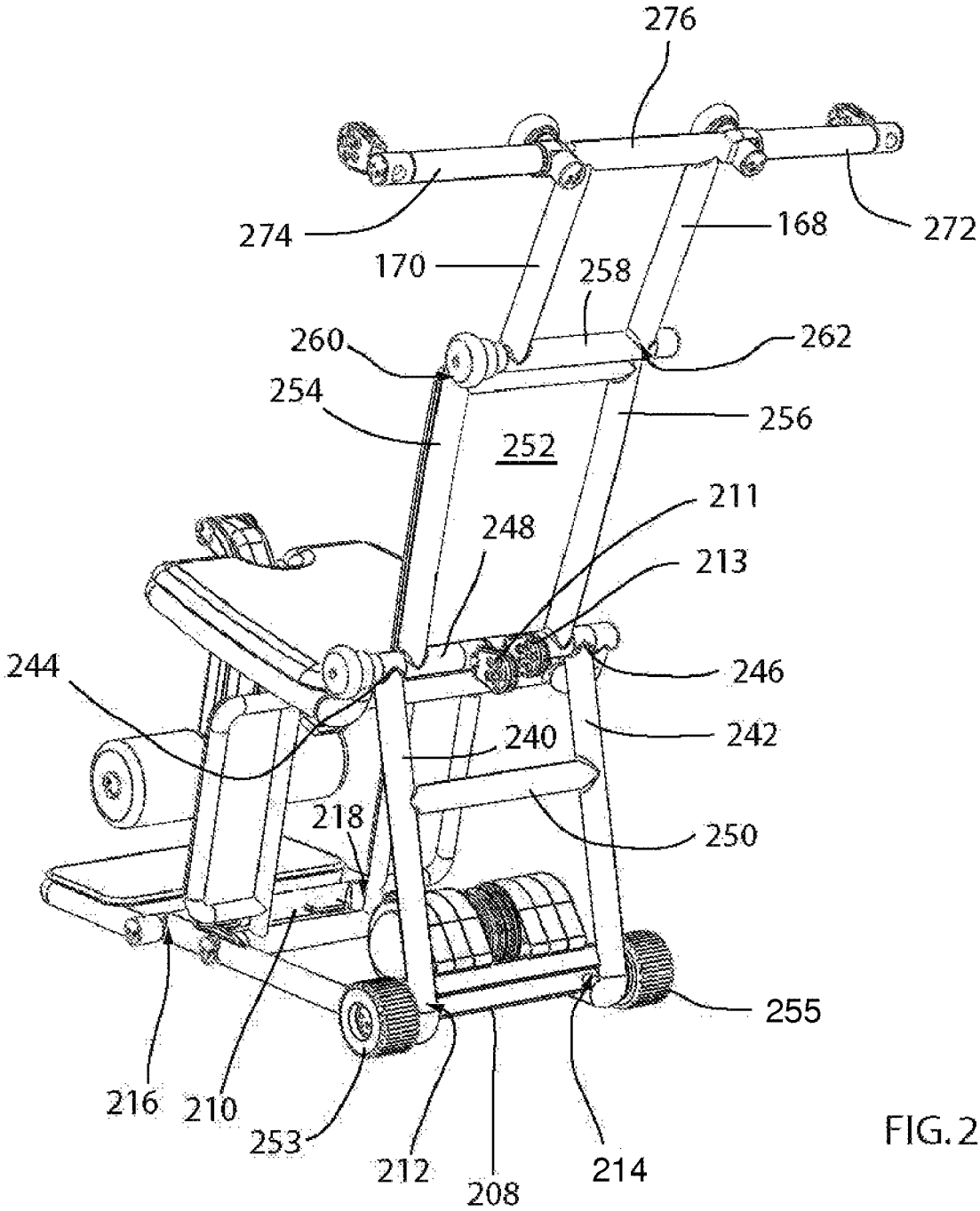
FIG. 2 is a rear angled view of the multi-purpose exercise device of FIG. 1, according to an embodiment of the present invention.
Figure 3:
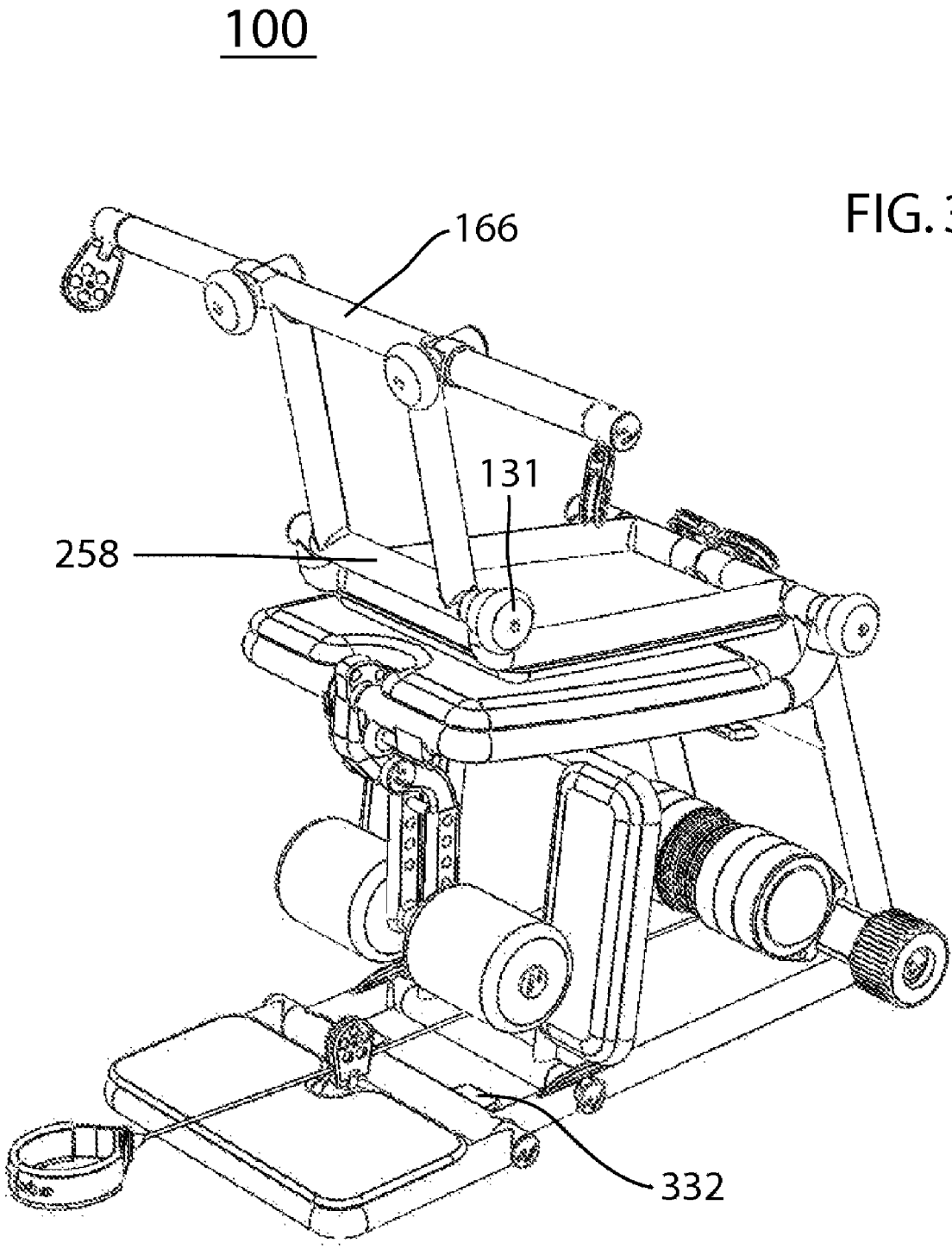
FIG. 3 is a front angled view of the multi-purpose exercise device of FIG. 1 comprising another configuration, according to an embodiment of the present invention.

According to an embodiment of the present invention, as shown in FIG. 1, a collapsible multi-purpose exercise device 100 is illustrated. The exercise device 100 comprises a base 102 that includes a first support member 104 and a second support member 106. It should be noted that the base 102 as shown can also be a solid piece of metal, plastic, composite, or combination thereof. The first support member 104 and the second support member 106 being situated parallel to each other. As shown in FIG. 2, the exercise device 100 also comprises a rear lateral support member 208 and a front pivotable lateral support member 210. The rear lateral support member 208 is adjoined with a first end 212 of the first support member 104 and a first end 214 of the second support member 106. The front pivotable lateral support member 210 is adjoined with a second end 216 of the first support member 104 and a second end 218 of the second support member 106. As shown in FIG. 3, a locking mechanism 332 secures the bottom platform 134 at one or more positions. A set of rolling members 253, 255 are rotatably affixed each end 212, 214 of the first and second support members 104, 106, respectable. The rolling members 253, 255 allow a user to easily move the exercise device 100.

Figure 7:
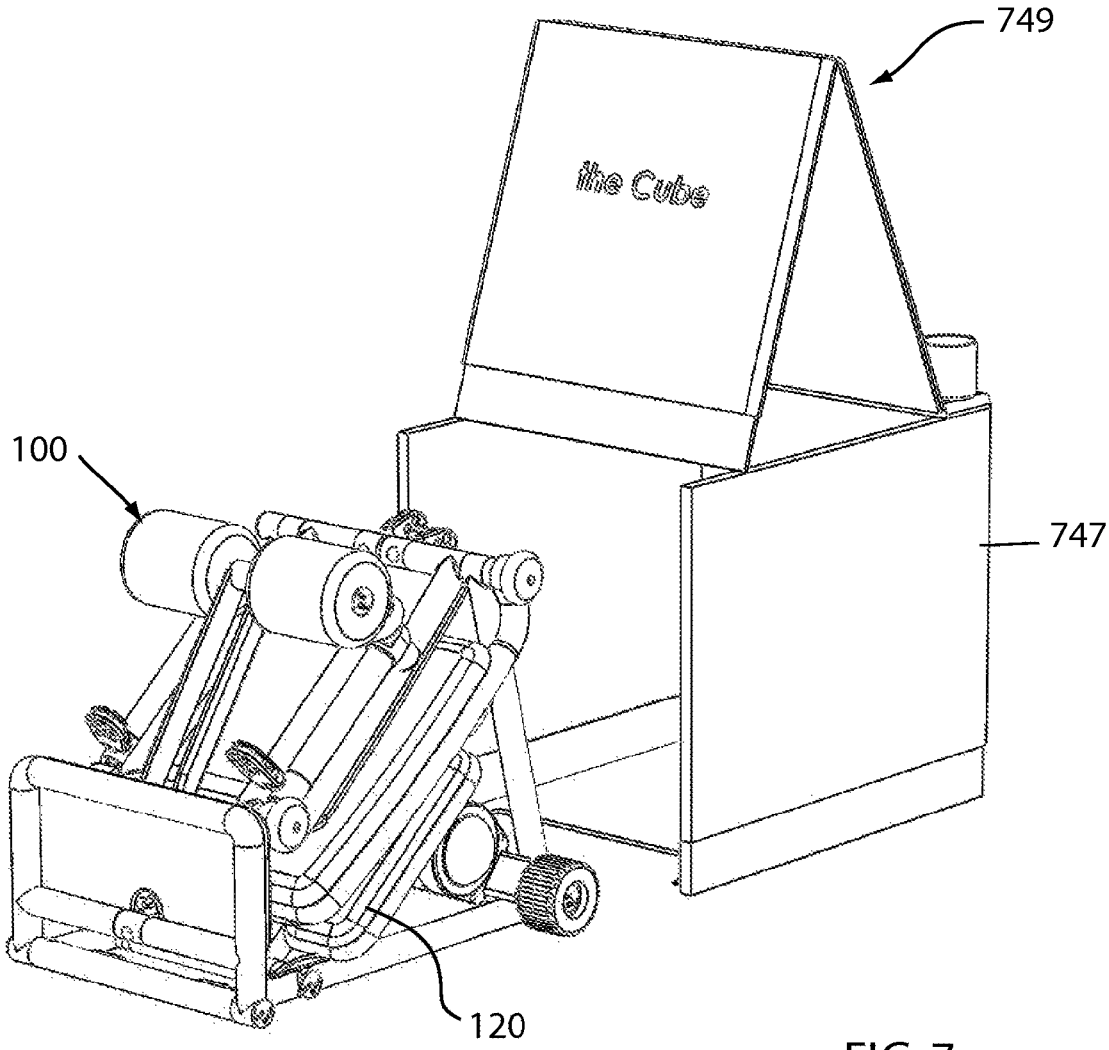
FIG. 7 is a front angled view of the multi-purpose exercise device of FIG. 1 in a storage configuration, according to an embodiment of the present invention.

The exercise device 100 also comprises a first foot support member 120 and a second foot support member 122 that are affixed to opposite ends of a lower pivotable lateral support member 124. A first end 126 of the lower pivotable lateral support member 124 is pivotably secured to the first support member 104 of the base 102. A second end 128 of the lower pivotable lateral support member 124 is pivotably secured to the second support member 106 of the base 102. At least one locking mechanism 130 secures the lower pivotable lateral support member 124 and the foot support members 120, 122 at one or more positions. The lower pivotable lower lateral support member 124 allows the first foot support member 120 and the second foot support member 122 to be pivoted to one or more positions as shown in FIG. 7. FIG. 7 shows the first foot support member 120 and the second foot support member 122 as being pivoted towards the rear portion of the exercise device 100. The foot support members 120, 122 allow a user to perform various exercises while being situated in front of the exercise device 100. For example, a user can place his/her feet against the foot support members 120, 122 to perform seated rows.

A bottom platform 134 is pivotably secured to the front pivotable lateral support member 210 for allowing the bottom platform 134 to pivot in an upward direction. For example, FIG. 7 shows the bottom platform as being pivoted in an upward position. The bottom platform 134 extends in an outward direction from the base 102. In one embodiment, the bottom platform 134 can be used as a foot rest. At least one locking mechanism 136 secures the bottom platform 134 at one or more positions.

A first vertical support member 240 is affixed to the first end 212 of the rear lateral support member 208. A second vertical support member 242 is affixed to the second end 214 of the front pivotable lateral support member 210. In one embodiment, the first vertical support member 240 and the second vertical support member 242 are situated parallel to each other and are angled less than 90 degrees with respect to the base 102. Another lateral support member 250 is situated between and affixed to the first vertical support member 240 and the second vertical support member 242. An upper end 244 of the first vertical support member 240 and an upper end 246 of the second vertical support member 242 are pivotably secured to opposite ends of an intermediate pivotable lateral support member 248.

The intermediate pivotable lateral support member 248 comprises part of a back support frame 252. The back support frame 252 includes at least the intermediate pivotable lateral support member 248 and a first upper vertical support member 254 and a second upper vertical support member 256. The first and second upper vertical support members 254, 256 of the back support frame 252 are affixed at opposite positions on the intermediate pivotable lateral support member 248. In one embodiment, a back cushion 164, pad, plate, or the like is attached to the back support frame 252. An upper pivotable lateral support member 258 is pivotably secured to an end 260, 262 of the first and second upper vertical support members, 256 of the back support frame 252, respectively.

The upper pivotable lateral support member 258, in one embodiment, can comprise an upper portion of the back support frame 252 and/or a support base for an upper exercise member 166. The upper exercise member 166, in one embodiment, is supported by a first upper vertical support member 168 and a second upper vertical support member 170. The first and second upper vertical support members 168, 170 being situated parallel to each other and affixed to opposite ends the upper pivotable lateral support member 258. The upper exercise member 166 comprises a right pivotable member 272, a left pivotable member 274, and a center support member 276. The right and left pivotable members 272, 274 are pivotable secured to opposite ends of the center support member 276 and can be pivoted inwards towards the first and second upper vertical support members 168, 170, respectively.

The exercise device 100 also comprises a seat frame 178. The seat frame 178 comprises a first support member 580 and a second support member 582. The first support member 580 of the seat frame 178 is pivotably secured to a first end 184 of the intermediate pivotable lateral support member 248. The second support member 582 of the seat frame 178 is pivotably secured to a second end 186 of the intermediate pivotable lateral support member 248. The seat frame 178, in one embodiment, also comprises a front support member 588 that communicates with a first end 590 of the first support member 580 and a first end 592 of the second support member 582.

Figure 5:
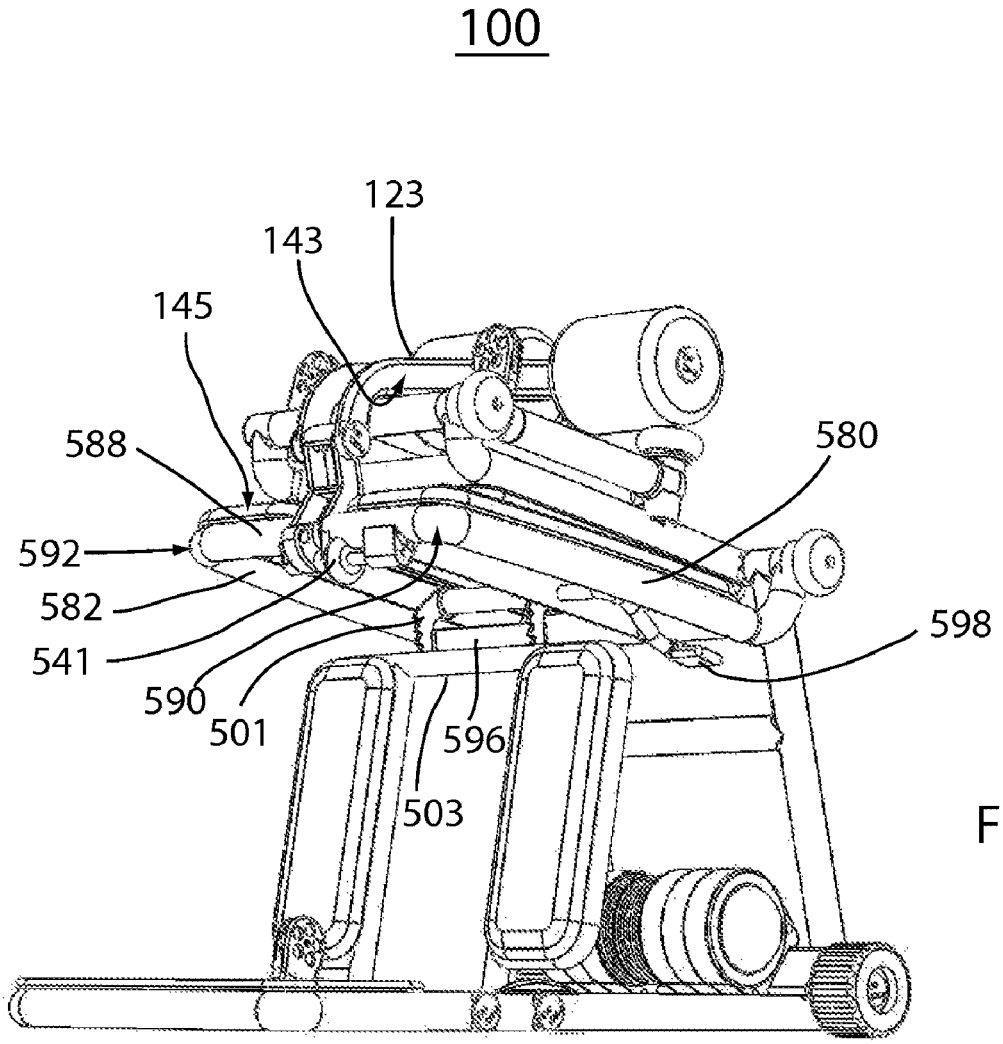
FIG. 5 is a front angled view of the multi-purpose exercise device of FIG. 1 comprising another configuration, according to an embodiment of the present invention.
Figure 6:
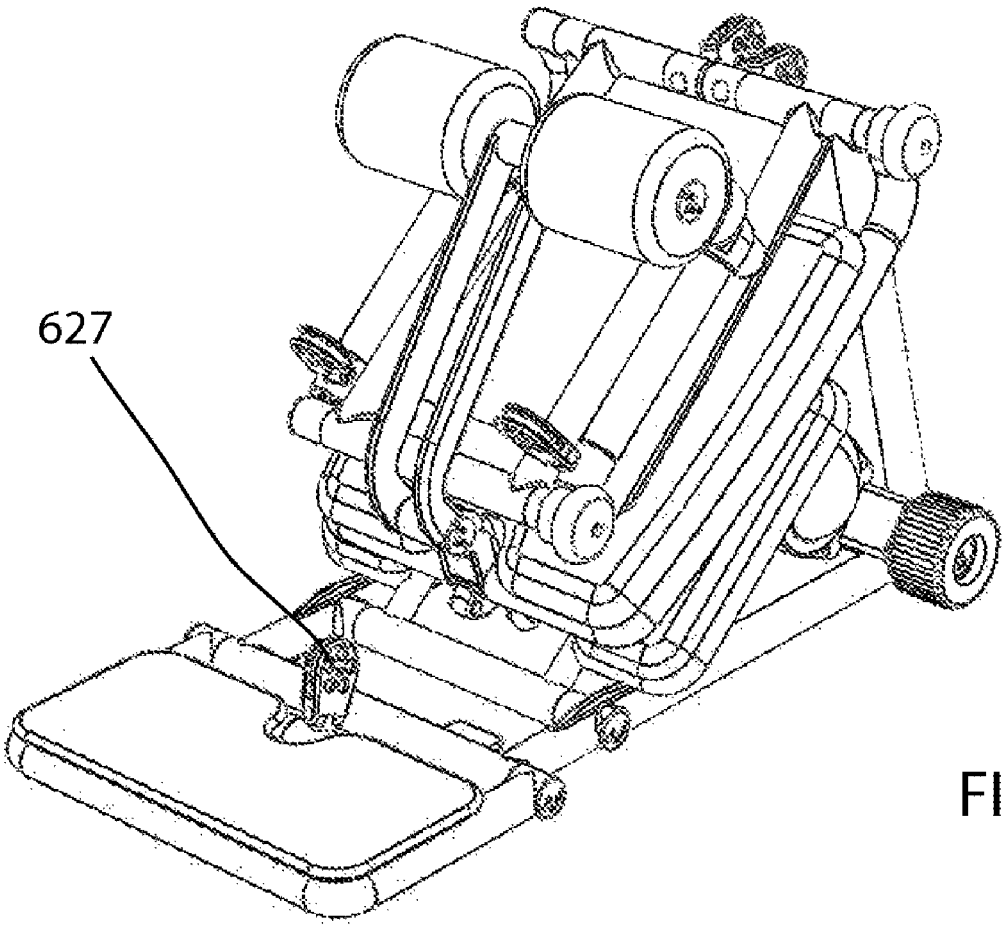
FIG. 6 is a front angled view of the multi-purpose exercise device of FIG. 1 comprising another configuration, according to an embodiment of the present invention.

The seat frame 178 also comprises a seat cushion 194, pad, plate, or the like. In one embodiment the seat frame 178 includes a pivoting mechanism 596 that allows the seat frame 178 to pivot up or down. In the example of FIG. 5, the pivoting mechanism 596 comprises a handle 598 affixed to securing members 501. The securing members 501 securely engage an upper support member 503 affixed to each of the foot support members 120, 122. The handle 598 allows for the securing members 501 to be disengaged from the upper support member 503, adjust the angle of the seat frame 178, and to collapse the seat frame 178, as shown in FIG. 6.

The exercise device 100 also comprises a resistance apparatus 105 that, in one embodiment, is securely affixed to rear lateral support member 208 of the base 102. The resistance apparatus 105 is configured to cooperate with at least one connector 107. The example of FIG. 1 shows two connectors 107, 109 cooperating with the resistance apparatus 105. FIG. 1 also shows the connectors 107, 109 as being a cable. It should be noted that the present invention is not limited to the connectors 107, 109 being cables. The resistance apparatus 105 provides a varying degree of resistance when at least one of the connectors 107, 109 is pulled. For example, as a user pulls one of the connectors 107, 109 out of the resistance apparatus 105 a resistive force is experienced by the user. In one embodiment, each connector 107, 109 cooperating with the resistance apparatus 105 are provided with an isolated movement. Stated differently, each connector 107, 109 can be moved independent of each other, thereby providing a user more isolated control over an exercise.

In another embodiment, the resistance apparatus 105 can be configured so that each connector 107, 109 is required to be moved in tandem. In this embodiment, if a user only pulls one connector 107, 109 a resistive force is not experienced until the other connector 107, 109 is pulled. Alternatively, if the connectors 107, 109 are not pulled at the same time, the resistance apparatus 105 does not release either of the connectors 107, 108. As a user releases a connector 107, 109 it retracts back into the resistance apparatus 105. The resistance apparatus 105 can be configured to provide the same resistance to each connector 107, 109 or an independent resistance (e.g., a different resistance) to each connector 107, 109.

The exercise device 100 comprises, in one embodiment, a set of pulleys 211, 213 affixed to the intermediate pivotable lateral support member 248 and a set of pulleys 115, 117 affixed to each end 119, 121 of the right and left pivotable members 274, 276 of the exercise member 276. The various pulleys 211, 213, 115, 117 allow for connectors 107, 109, to positioned on the exercise device 100 at various locations for performing one or more exercises. The exercise device 100 also, in one embodiment, also comprises a leg curl/extension bar 123 pivotably secured to the front support member 588 of the seat frame 178. One or more connectors 107, 109 can be attached to leg curl/extension bar 123 for providing resistance to a user during an exercise. The leg curl/extension bar 123 also comprises one or more pads 125. It should be noted that although FIG. 1 shows two separate pads 125, a single pad can be used. It should also be noted that although FIG. 1 shows a single leg curl/extension bar 123, two independent leg curl/extension bars can be used. This allows a user to separately isolate his/her left and right legs during an exercise. In this embodiment, two separate connectors can be attached to each leg curl/extension bar to provide separate resistive forces as discussed above.

As discussed above the resistance apparatus provides a resistive force during exercises performed by a user using one or more of the connectors 107, 109. The multi-purpose exercise device 100 is configured to provide a plurality of different exercise options to a user. For example, the connectors 107, 109 can cooperate with the set of pulleys on the upper exercise member 166 to perform lateral arm pull-downs, lateral pull-downs, seated chest press, one or two arm triceps kickbacks, internal and external shoulder rotations, and the like. One or more pulleys 627 can also be attached to the bottom platform 134. This allows for one or more connectors 107, 109 to be positioned at the bottom platform 134 for performing exercises such as seated rows, standing lateral rows, single or double bicep curls, front arm raises, lateral arm raises, standing leg curls/extensions, lateral raises, standing exercises, sitting exercises, leg exercises, and the like. The leg curl/extension bar 123 can be configured for performing exercises such as seated calf raises, standing hip abductor and adductor, and the like. The connectors 107, 109 can be configured to accept a plurality of grips 137, 139 such as handles, bars, triceps ropes, and the like.

It should be noted that the present invention is not limited to the configuration shown throughout FIGS. 1-8. For example, one or more exercise members 166 can be added or moved to various locations on the exercise device 100. This allows a user to configure the positioning of the connectors 107, 109 for performing additional exercises, adjusting connector height, customizing range of motion of exercises, and the like. For example, the upper exercise member 166 can be moved to a lower position or an additional exercise member can be added so that a user can perform butterfly curls, incline presses, or the like.

One advantage of the present invention is that the multi-purpose exercise device 100 can be collapsed into a configuration allowing it to be stored in smaller spaces than current multi-purpose exercise devices. Also, various elements of the multi-purpose exercise device 100 can be collapsed/folded to offer additional configurations for performing exercises. In one embodiment, the intermediate lateral support member 248 is configured to pivot either towards the front of the exercise device 100 and/or the back of the exercise device 100. Each end 184, 186 of the intermediate lateral support member 248, in one embodiment, is pivotable and at least one locking mechanism 129 secures the intermediate lateral support member 248 at one or more positions.

In one embodiment, as the intermediate lateral support member 248 is pivoted towards the back of the exercise device 100, the back support frame 252 can be positioned at various angles and parallel with the seat frame 178. This allows a user to perform additional exercises using the exercise device 100. Alternatively, a user can prepare the exercise device 100 for storage by pivoting the intermediate lateral support member 248 (and the back support frame 252) towards the front of the exercise device until the back support frame 252 is substantially parallel with the seat frame 178, as shown in FIG. 3.

FIG. 3 also shows the upper pivotable lateral support member 258 as being partially pivoted in a clockwise direction thereby positioning the upper exercise member 166 and its support members 168, 170 in an upright position. At least one locking mechanism 131 secures the upper pivotable lateral support member 258 at one or more positions. The allows the upper exercise member 166 to be used as a support rail by a user when performing various exercises such as standing hip abductor and adductor, standing leg curls, and the like. The upper pivotable lateral support member 258 can be further pivoted in a clockwise direction until the first and second vertical support members 168, 170 of the upper exercise member 166 are substantially parallel with the first and second upper vertical support frames 254, 256 of the back support frame 252, as shown in FIG. 4.

Figure 4:
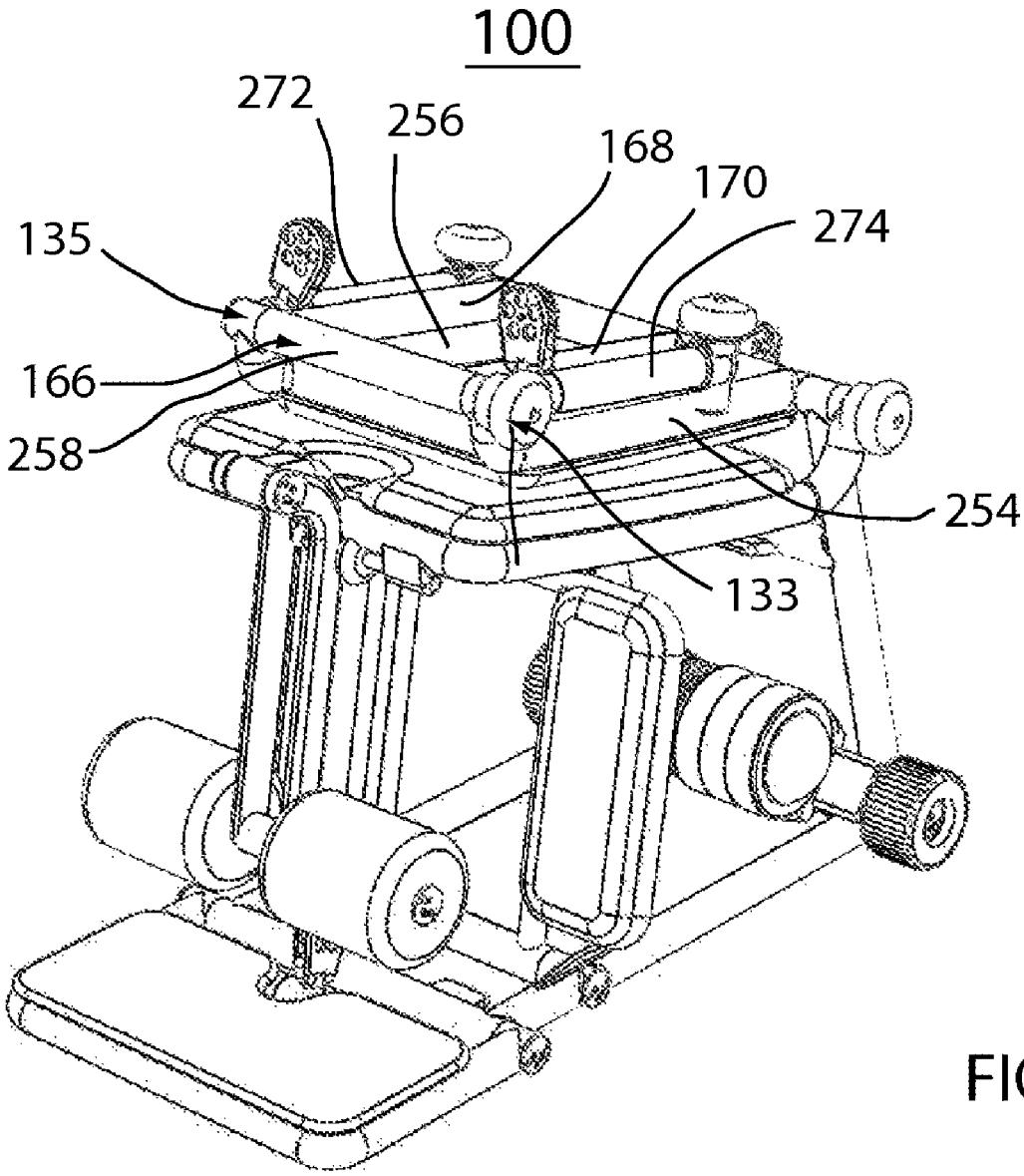
FIG. 4 is a front angled view of the multi-purpose exercise device of FIG. 1 comprising another configuration, according to an embodiment of the present invention.

FIG. 4 further shows the right and left pivotable members 272, 274 of the upper exercise member 166 as being pivoted inwards towards the first and second vertical support members 168, 170 of the upper exercise member 166. In this configuration the right and left pivotable members 272, 274 are substantially parallel with first and second vertical support members 168, 170 of the upper exercise member 166 and the first and second upper vertical support frames 254, 256 of the back support frame 252. This configuration further prepares the exercise device for storage. At least one locking mechanism 133, 135 pivotably secures the right and left pivotable members 272, 274 at one or more positions for allowing the right and left pivotable members 272, 274 to be pivoted.

The exercise device 100 can be further configured for storage by releasing a locking mechanism 541 securing the leg curl/extension bar 123 and pivoting the leg curl/extension bar 123 in a clockwise direction. The leg curl/extension bar 123 can be pivoted so that a front facing surface 143 of the leg curl/extension bar 123 faces a top surface of the 145 of the seat cushion 194. As discussed above the first and second foot support members 120, 122 are affixed to a pivotable lateral support member 124. The pivotable lateral support member 124 allows the first and second foot support members 120, 122 to be pivoted towards the rear lateral support member 208 of the base 102, as shown, in FIG. 5. Pivoting the first and second foot support members 120, 122 towards the rear lateral support member 208 of the base 102 allows the seat frame 178 to be pivoted downward, as shown in FIG. 6. Therefore, the leg curl/extension bar 123, the right and left pivotable members 272, 274, the first and second vertical support members 168, 170 of the upper exercise member 166, the first and second vertical support members 580, 582 of the seat frame 178, seat frame 178 and cushion 194, and the first and second foot support members 120 are all substantially parallel to each other when pivoted to a storage configuration.

Figure 8:
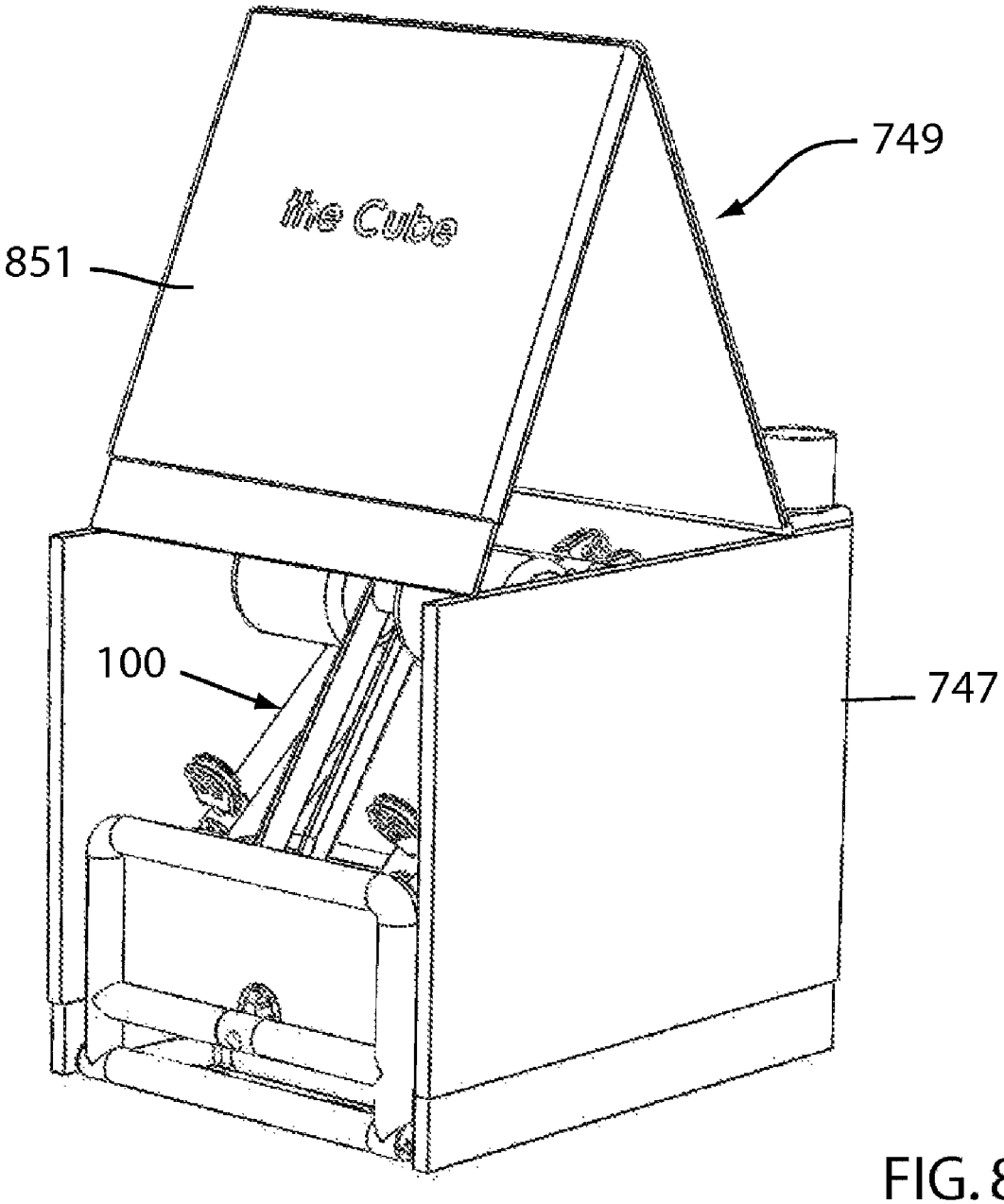
FIG. 8 is front angled view showing the multi-purpose exercise device of FIG. 1 in the storage configuration of FIG. 7 and being stored away in a storage cube.

As discussed above, the bottom platform 134 is also pivotable. As the front pivotable lateral support member 210 is pivoted in a clockwise direction, the bottom platform 134 can be positioned at an upright position, as shown in FIG. 7. FIG. 7 shows the exercise device 100 as being collapsed into a storage configuration. This configuration is advantageous because it allows the exercise device 100 to be stored in smaller areas than convention multi-purpose exercise machines. For example, FIGS. 7 and 8 illustrate a storage cube 747. The storage cube 747 is configured to accept the collapsed exercise device 100. In one embodiment, the storage cube 747 comprises a foldable top 749. FIG. 8 shows the collapsed exercise device 100 residing within the storage cube 749. The top 749 of the storage cube can be lowered, wherein a front portion 751 of the storage cube encloses the storage cube. It should be noted that FIG. 7 and FIG. 8 only show one configuration of the storage cube 747. For example, the storage cube 747 can be collapsible, configured so that only the front portion 751 slides open, or the like. The storage cube 747 can then be used for other purposes such as an end table.

To even further illustrate the space saving design of the multi-purpose exercise device 100, when folded, the dimensions can be 21 inches wide by 24 inches high by 25 inches deep. It should be noted that this is only an illustrative example and does not limit the multi-purpose exercise device 100 to comprising folded dimensions of 21 inches wide by 24 inches high by 25 inches deep or unfolded dimensions that result in these folded dimensions. It should also be noted that the multi-purpose exercise device 100 can also comprise one or more wheels (not shown). The wheels allow for the multi-purpose exercise device 100 to be easily moved from location to location.

As can be seen from the above discussion, the present invention provides an advantageous multi-purpose exercise device. A user is able to perform multiple exercises on the present invention and configure the exercise device so suit personal exercise preferences. Another advantage of the preset invention is that it can be configured in such a manner that minimal storage space is required. For example, the present invention is configured so that various parts of the exercise device are collapsible and/or foldable thereby giving the present invention a small footprint when collapsed in a storage configuration.

NON-LIMITING EXAMPLES

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments, and it is intended that the appended claims cover any and all such applications, modifications, and embodiments within the scope of the present invention.

What is claimed is:

1. A foldable exercise device comprising:

a seat with a front portion and a rear portion, wherein the front portion is pivotably attached to at least one support member, wherein the rear portion includes an intermediate pivotable lateral support member attached between a first vertical support member and a second vertical support member, wherein each of the first vertical support member and the second vertical support member include a top end and a bottom end, whereby the seat is configured to pivot to at least two positions including an open position which is substantially horizontal and a folded position which is in a downward direction toward the bottom end of the first vertical support member and the second vertical support member;

a back support pivotably secured to the intermediate pivotable lateral support member, wherein the back support is configured to pivot to at least two positions including an open position which is substantially vertical and a folded position which is substantially parallel to the seat;

wherein at least the back support is pivotable independent of the first vertical support member and the second vertical support member;

an upper exercise member comprising a center support member, a right pivotable member, and a left pivotable member, wherein the right pivotable member and the left pivotable member are pivotably secured to the center support member, and wherein the center support member is secured to the back support; and a resistance apparatus secured between the first vertical support member and the second vertical support member, wherein the resistance apparatus is configured to supply a variable resistive force when at least one connector coupled to the resistance apparatus is pulled by a user.

2. The foldable exercise device of claim 1, further comprising:

a base with front portion and a rear portion, wherein the rear portion is attached to the bottom end of the first vertical support member and the bottom end of second vertical support member.

3. The foldable exercise device of claim 2, wherein at least one rolling member is mechanically coupled to the base.

4. The foldable exercise device of claim 1, wherein the at least one connector is configured for allowing the user to perform at least one of:

arm exercises;
back exercises;
shoulder exercises;
chest exercises;
leg exercises; and
stomach exercises.

5. The foldable exercise device of claim 1, further comprising:

a rear lateral support member disposed between the first vertical support member and the second vertical support member and wherein the resistance apparatus is attached to the rear lateral support member.

6. The foldable exercise device of claim 5, further comprising:

a lower pivotable lateral support member pivotably secured to a first support member cooperating with the bottom end of the first vertical support member and a second support member cooperating with the bottom end of the second vertical support member; and a first foot support member and a second foot support member affixed to the lower pivotable lateral support member, wherein the lower pivotable lateral support member is configured to pivot the first foot support member and the second foot support towards the rear lateral support member.

7. The foldable exercise device of claim 1, wherein the right pivotable member and the left pivotable member are configured to be pivoted in a direction substantially perpendicular to the seat and substantially parallel to the back support.

8. The foldable exercise device of claim 1, further comprising:

a bottom platform pivotably attached to a front lateral pivotable support member, wherein the bottom platform is configured to pivot in an upward direction toward the seat.

9. The foldable exercise device of claim 1, further comprising:

a leg exercise member pivotably secured to the front portion of the seat, wherein the leg exercise member is configured to pivot to at least two positions including a resting position substantially perpendicular to the seat and an extended position substantially parallel with the seat.

10. The foldable exercise device of claim 1, wherein the at least one connector is configured for allowing the user to perform at least one of:

exercises while sitting on the seat;
exercises while standing; and
exercises while sitting on floor.

11. The foldable exercise device of claim 1, wherein the right pivotable member and the left pivotable member being pivotable inwards and situated substantially parallel to a first upper vertical support member and a second upper vertical support member, respectively, wherein the first upper vertical support member and the second vertical support member being affixed to an upper pivotable lateral support member that pivots the first upper vertical support member and the second vertical support member substantially parallel to the seat.

12. The foldable exercise device of claim 1, further comprising:

a lower lateral pivotable support member pivotably secured to a first support member and a second support member cooperating with the first and second vertical support members, respectively, wherein the lower lateral pivotable support member situates a first foot support member and a second foot support member at a position where the seat is able to be pivoted downwards.

13. The foldable exercise device of claim 1, further comprising:

a leg exercise member pivotably secured to the front portion of the seat, wherein the leg exercise member is configured to be pivoted so that it is situated substantially on top of the seat, back support and upper exercise member when pivoted in a storage position.

14. The foldable exercise device of claim 1, further comprising:

a storage device comprising at least a first side portion, a second side portion, a rear portion coupled to a back portion of the first side portion and a back portion of the second side portion, and a collapsible top portion comprising a first portion and a second portion, wherein the first portion of the collapsible top portion collapses over a top portion of the first side portion and a top portion of the second side portion, and wherein the second portion of the collapsible top portion abuts a front portion of the first side portion and a front portion of the second side portion, wherein the storage device receives the foldable exercise device therein when the foldable exercise device is in a folded configuration.

* * * * *